US005232046A

United States Patent [19]

Gallucci et al.

[11] Patent Number: 5,232,046

[45] Date of Patent: Aug. 3, 1993

[54] STRAND CASTING APPARATUS AND METHOD

[75] Inventors: Frank Gallucci, North Huntingdon; Joseph Pietryka, Pittsburgh, both of Pa.

[73] Assignee: Mesta International, Pittsburgh, Pa.

[21] Appl. No.: 805,462

[22] Filed: Dec. 10, 1991

Related U.S. Application Data

[63] Continuation-in-part of Ser. No. 468,473, Jan. 22, 1990, abandoned.

[51] Int. Cl.[5] ..... B22D 11/04

[52] U.S. Cl. ..... 164/478; 164/439; 164/488

[58] Field of Search ..... 164/437, 488, 337, 439, 164/478, 475, 415

[56] References Cited

U.S. PATENT DOCUMENTS 4,341,258 7/1982 Wigdahl ..... 164/338.1

4,751,955 6/1988 Feldmann et al. ..... 164/439

FOREIGN PATENT DOCUMENTS 2935840 3/1980 Fed. Rep. of Germany ..... 164/439

57-47558 3/1982 Japan ..... 164/478

59-225861 12/1984 Japan ..... 164/475

60-250860 12/1985 Japan ..... 164/475

*Primary Examiner*—Kuang Y. Lin

*Attorney, Agent, or Firm*—Armstrong, Westerman, Hattori, McLeland & Naughton

[57] ABSTRACT

Continuous casting apparatus comprising a tundish having a pouring nozzle communicating with a closed, pressurized pouring box which has an outlet corresponding to the inlet of a mold such that the entry conditions of liquid metal into the mold are not adversely affected by the flow of liquid metal into the mold thereby providing a uniform skin of solid metal about a liquid metal core as the cast product is withdrawn from the mold.

20 Claims, 5 Drawing Sheets

STRAND CASTING APPARATUS AND METHOD

This application is a continuation-in-part of application Ser. No. 07/468,473, filed Jan. 22, 1990, now abandoned.

FIELD OF THE INVENTION

The invention relates to apparatus and methods for continuously casting a metal, such as steel, into a flat strand having a thickness of less than about 75 mm (3 inches). More particularly, it relates to an improvement for continuously introducing liquid metal at a high mass rate into a narrow casting mold having a short residence time under substantially constant entry conditions in the mold.

BACKGROUND OF THE INVENTION

Flat steel strands are continuously cast on casting lines in oscillating molds which have generally rectangularly shaped cavities defined by two opposed pairs of general vertical side walls. Liquid metal from upstream steel-making operations is poured into a mold through a pouring nozzle of an overhead tundish. The tundish pouring nozzle typically extends through a protective slag cover and into the underlying liquid metal in the mold cavity for introducing the liquid metal with low turbulence in order to minimize splashing or entraining slag. Also, the pouring nozzle must be sufficiently spaced from the mold side walls in order to not to interfere with the formation of a strand skin having smooth surface and low transverse stresses.

The rate at which a thin flat metal strand, having a thickness of about 75 mm. or less, can be cast is limited to the maximum rate at which liquid metal can be poured into the mold cavity without substantially affecting the formation of the strand skin. Various specially designed tundish pouring nozzles and mold configurations have been developed for introducing liquid metal at high rates into the mold cavities. U.S. Pat. No. 4,811,779 discloses a design where a fan-shaped nozzle is submerged in a mold cavity for casting thin strip. Another design provides a funnel-shaped nozzle which extends between generally parallel side walls of a mold. While such narrow nozzles effectively distribute liquid metal in the mold cavity, they also tend to introduce turbulence in the metal which may interfere with the formation of a suitable strand skin. Also, narrowed nozzles are frequently sensitive to plugging because of the disposition of refractory particles, such as aluminum oxides, which may upset the entry conditions into the mold cavity.

BRIEF DESCRIPTION OF THE INVENTION

Continuous casting apparatus embodying the invention includes a tundish having a pouring nozzle; a mold having opposed generally vertical end walls and side walls defining a mold cavity with an inlet and an outlet and the side walls spaced apart a distance less than about 75 mm. and preferably less than about 50 mm., and an enclosed pouring box disposed between the tundish and the mold and having a cavity into which the tundish nozzle extends and which communicates with the mold cavity inlet.

The tundish pouring nozzle is submerged in a body of liquid metal contained in the pouring box cavity and which liquid metal also fills the entire mold cavity. Thus, the tundish is in continuous liquid metal communication with the narrow mold cavity and the entry conditions into the mold cavity are not substantially adversely affected by the liquid flow from the tundish nozzle. Standard tundish nozzle designs may be used and the apparatus of the invention may employ molds having conventional parallel side walls (although other configurations may be used).

The pouring box is mounted on the mold, for oscillation with the mold, and preferably has a heater outlet connection for maintaining the temperature of the pouring box outlet and avoiding freezing of the steel in such outlet.

Other details, objects and advantages of the invention will be apparent from the following detailed description and drawings.

Figure 3:
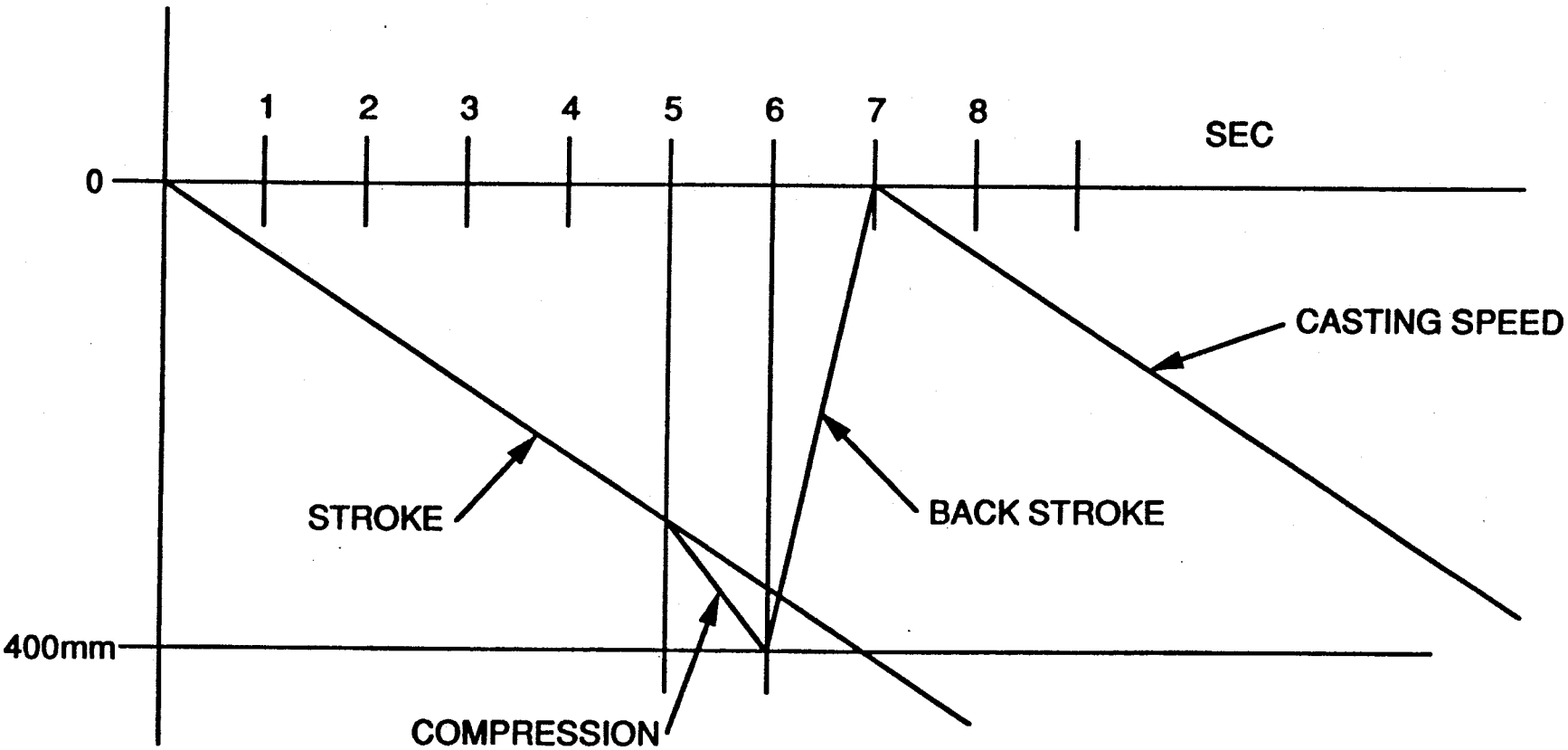
Figure 5:
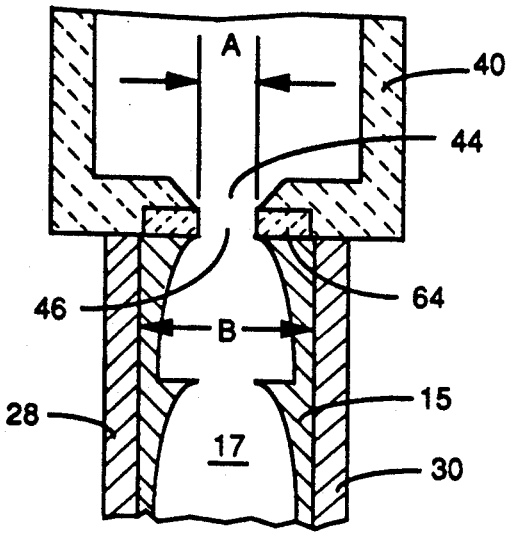
Figure 6:
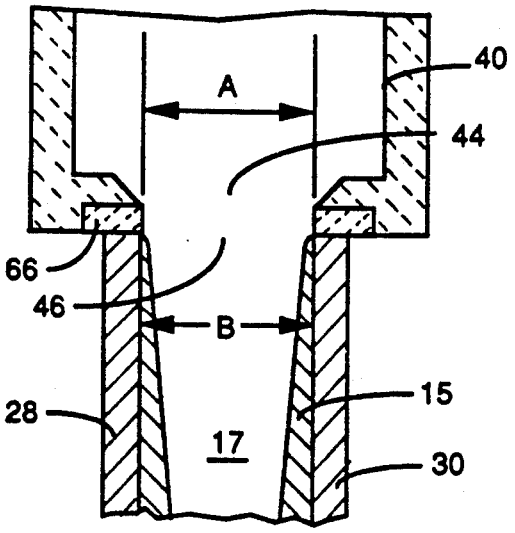

FIG. *2a–2d* schematically show the mold and the pouring box in extreme positions during the oscillation cycle;

FIG. 3 is a diagram showing the oscillation movement of the mold and associated pouring box;

FIG. *4a–4c* schematically show three different types of inserts between the pouring box and the mold;

FIG. 5 is a cross-sectional elevational view of a part of a pouring box and mold showing one form of constricted opening between these elements of a casting apparatus;

FIG. 6 is a cross-sectional elevational view of a part of a pouring box and mold showing an unconstricted opening, in accordance with the invention, between the pouring box and the mold.

Figure 7:
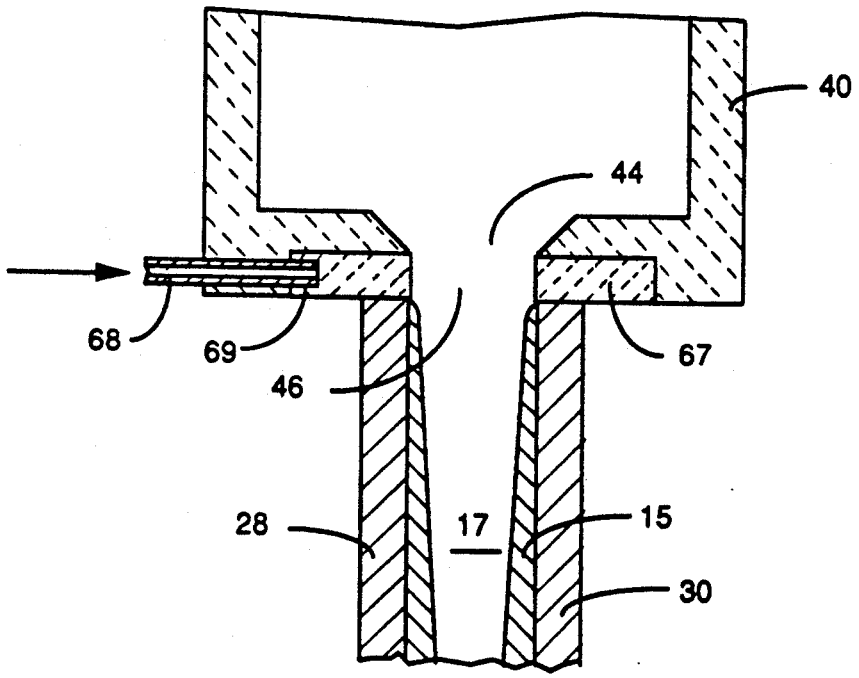
Figure 8:
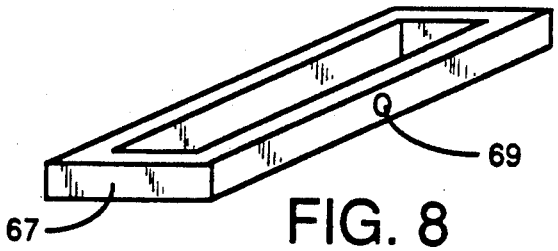

FIG. 7 is another, enlarged, cross-sectional elevation of part of a pouring box and mold, showing a mold sealing insert ring and means to inject an inert gas therein in accordance with one aspect of the invention, and FIG. 8 is an isometric view of a porous refractory insert and sealing ring for use between the pouring box and the mold in accordance with the invention.

DETAILED DESCRIPTION OF THE PREFERRED EMBODIMENT

Figure 1:
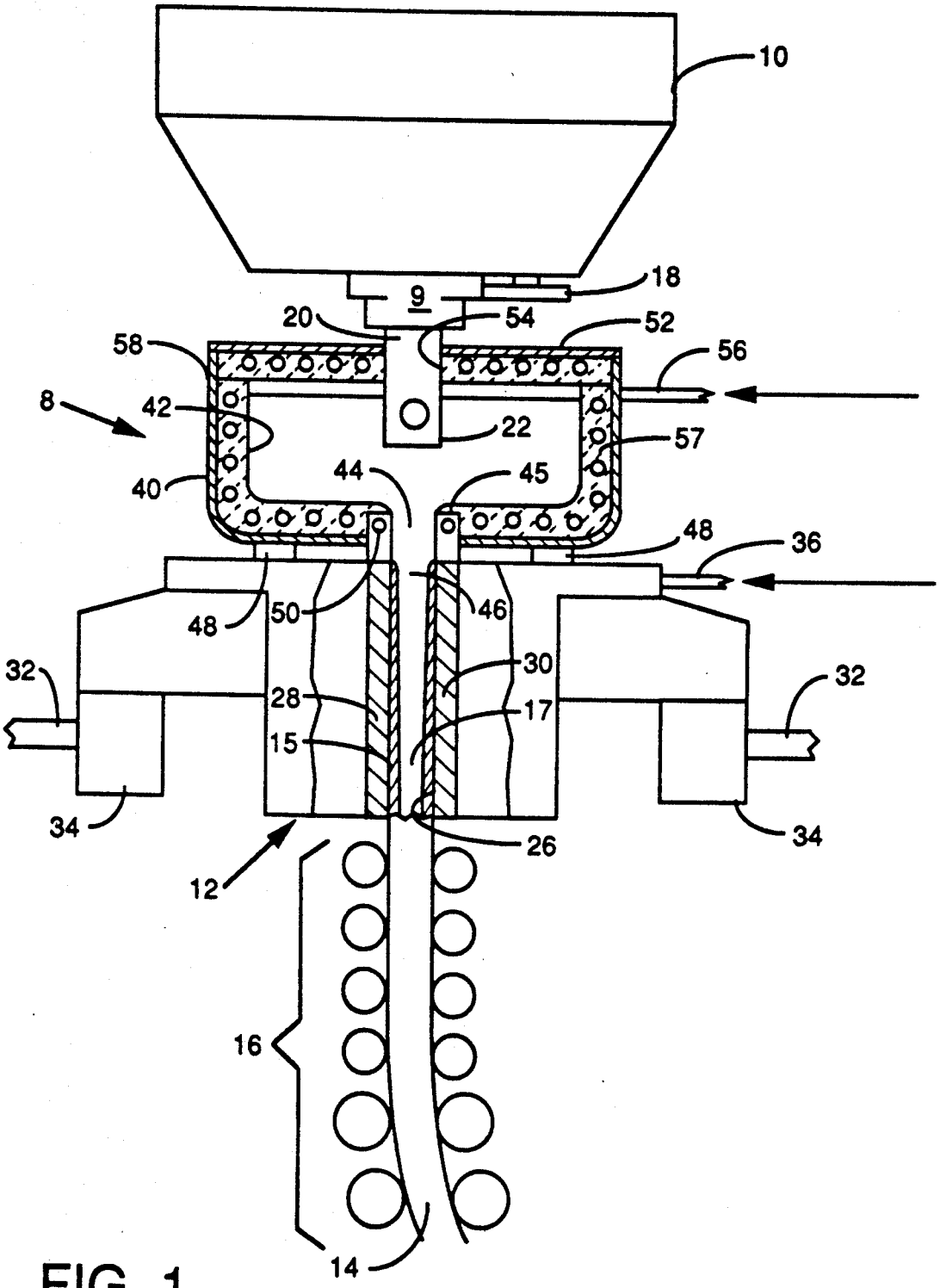
FIG. 1 schematically shows a casting apparatus embodying the principles of the present invention and comprises a substantially enclosed, oscillatable pouring box and casting mold.

FIG. 1 generally shows a vertical caster 8 including a tundish 10 which distributes liquid metal to a mold 12 for continuously casting a metal strand 14 which is guided from the mold 12 by a roll assembly 16.

The tundish 10 has a hydraulic slidegate valve 18 mounted on a tundish outlet connection 9 with a tundish pouring nozzle 20 extending from the valve 18. Any suitable standard nozzle adapted to be submerged in the liquid metal may be employed. Thus, the distal end 22 of the tundish pouring nozzle should be made of temperature and wear resistant materials.

The casting mold 12 has a mold cavity 26 defined by closely spaced apart sidewalls 28, 30 which extend between end walls (not shown). The end walls may be moved relative to each other between the side walls 28, 30 while a strand is being cast thereby to adjust the width of the strand 14. FIG. 1 depicts a mold 12 having a rectangular vertical mold cavity 26, although other configurations may be employed. The mold 12 is cooled by water which flows through mold water connections 32 and passageways (not shown) in the mold side walls 28, 30. The mold 12 is oscillated by a plurality of mold oscillators 34. Lubricants or inert gas are provided through lube inlet 36 to the mold 12 and then injected through small holes (not shown) in the mold sidewalls 28, 30 to lubricate the strand.

A roll assembly 16 guides the metal strand 14 from the casting mold 12 to downstream processing operations (not shown). In the case of most, if not all, steel compositions, the metal strand 14 will have a solid skin or shell 15 with a liquid metal core 17 which solidifies as the strand 14 travels through the roll assembly 16 from the mold 12.

A pouring box 40, constructed for example of a refractory material and having a metallic housing, is disposed between the tundish 10 and the mold 12. As shown in FIG. 1, the pouring box 40 has a cavity 42 with an outlet 44 juxtaposed with the mold cavity inlet 46. The outlet 44 preferably extends over substantially the full width of the mold 12 for reducing the velocity of the liquid metal flowing into the mold 12. Thus the nominal velocity (volume/time flowing through a cross sectional area) of the liquid metal into the mold 12 is about the nominal velocity of the liquid metal through the upper portion of the mold. The pouring box 40 is mounted on the mold 12 by suitable mounting connections 48 such that the pouring box 40 oscillates with the mold 12. Also, pouring box outlet connection 45 may contain embedded resistance wires 50 to heat the outlet 44 and thereby inhibit solidification of metal at those critical locations. A cover 52, also made of a refractory material and a metal housing, and having an aperture 54 for receiving the tundish pouring nozzle 20, encloses the pouring box cavity 42 so that an inert gas, e.g. argon, atmosphere may be introduced, through line 56, over the liquid metal in the pouring box 40. Alternatively, a protective slag may be maintained over the liquid metal in pouring box 40, for example by blowing in through line 56 a particulate slag-forming flux suspended in argon. In any case, liquid metal in the pouring box 40 is under the pressure imposed by such inert gas and other gases evolved from the liquid metal and the casting operation is carried out under such pressure.

Similar heating elements 50 may be embedded in the cement or other refractory material 57 which lines a metal housing 58 of the pouring box 40 and its cover 52 to maintain the temperature of the liquid metal in the pouring box 40.

When casting the strand 14, the end 22 of the tundish nozzle 20 remains submerged in liquid metal as the mold 12 and the pouring box 40 oscillate, so that there is continuous liquid communication between the tundish 10 and the mold 12 with essentially constant liquid entry conditions into the narrow mold cavity 46. Also, the process conditions along the mold side walls 28, 30 are substantially constant because of the static liquid head and relatively low turbulence in the mold cavity 26.

Oscillation of the pouring box and the mold is divided into three steps. First, there is a downward movement at the speed of withdrawal of metal in order to permit metal solidification to a thickness strong enough to allow the back stroke without destruction of the solidified skin or shell. The thickness of the shell at the end of the downward stroke is about 3 to 6 mm. The solidification time to achieve such thickness is about 4 to 6 seconds. Second, at the end of the downward stroke, in order to break the sticking of the shell on the mold wall, the mold and pouring box are moved faster. The resulting compression of the shell insures a relative sliding movement between the shell and the mold. Third, the mold 12 and the pouring box 40 are moved upward rapidly to the initial position, thereby allowing the liquid metal to fill the free cavity in the mold.

Figures 2A, 2B, 2C, 2D:
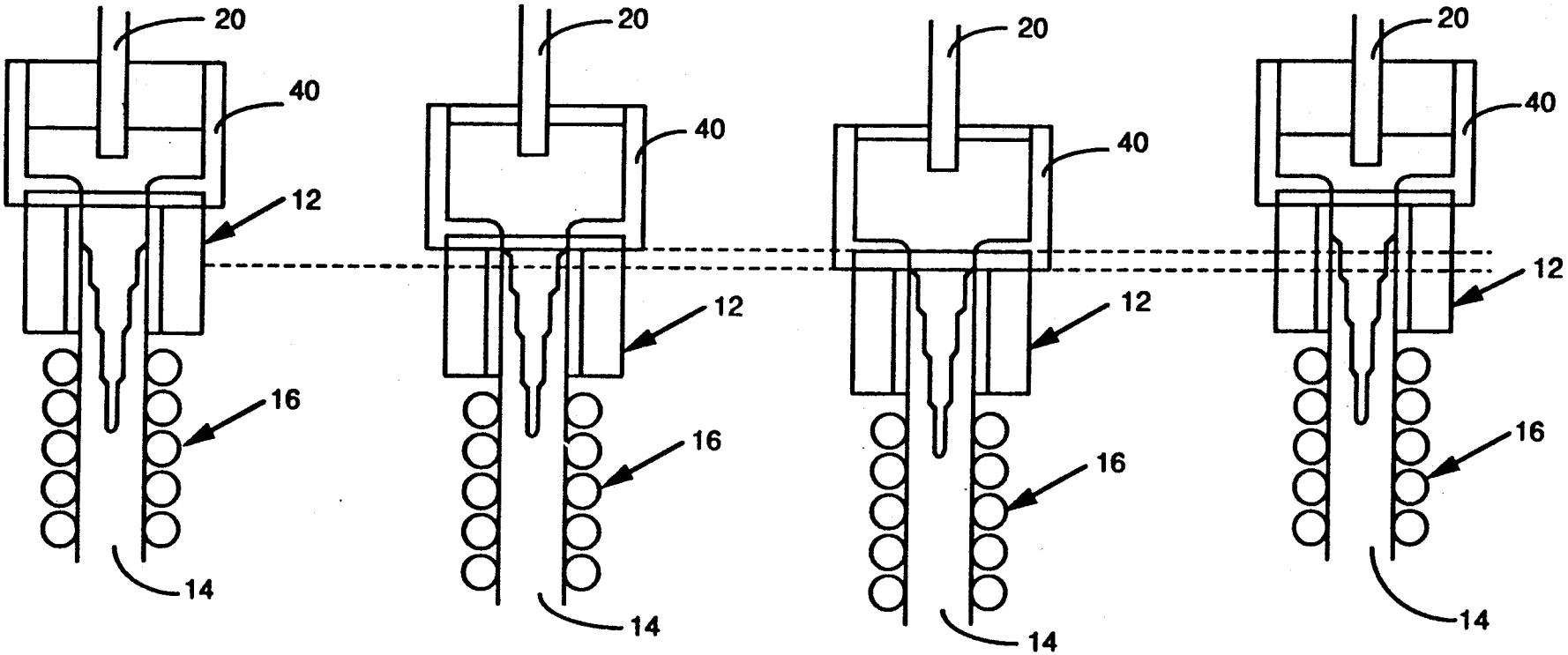

FIGS. 2a–2d depict the extreme positions of the mold 12 and the pouring box 40 during oscillation. FIG. 2a shows the initial position when the liquid metal is filling the mold cavity 46. FIG. 2b shows the end of the downward movement where the pouring box 40, mold 12 and the product 14 are moving at the same speed in order to solidify a 3 to 6 mm. shell. FIG. 2c shows the end of the downward movement of the pouring box 40 and mold 12 at higher speed than the product 14. The shell of the product 14 is sliding upward relative to the mold 12 and insuring the break of sticking between the shell and the mold wall. FIG. 2d shows the end of the fast back stroke and the initial position for the next cycle. During this movement, the molten steel fills the mold cavity 46.

FIG. 3 shows a typical oscillation diagram with three steps. The first step shows the downward motion of the pouring box 40, the mold 12 and the product 14 at the same speed equal to the casting speed. The second step shows the mold speed higher than the casting speed, and the third step shows the return of the mold 12 to the initial position at high speed.

Figure 4C:
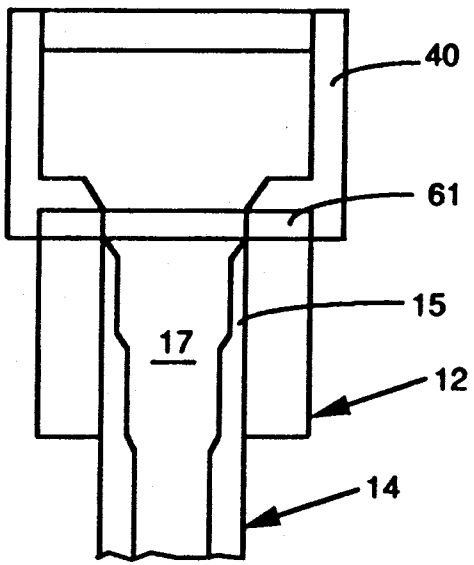
Figure 4B:
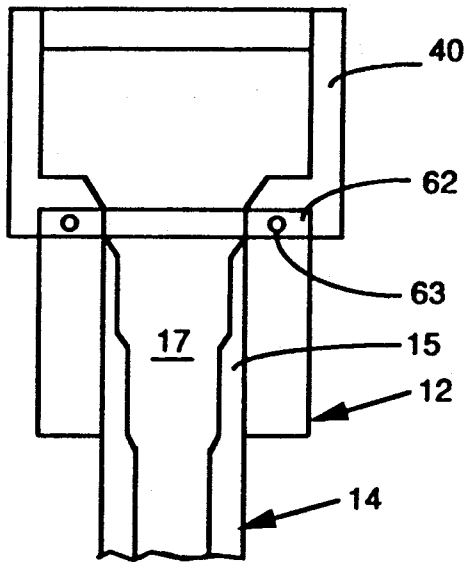
Figure 4A:
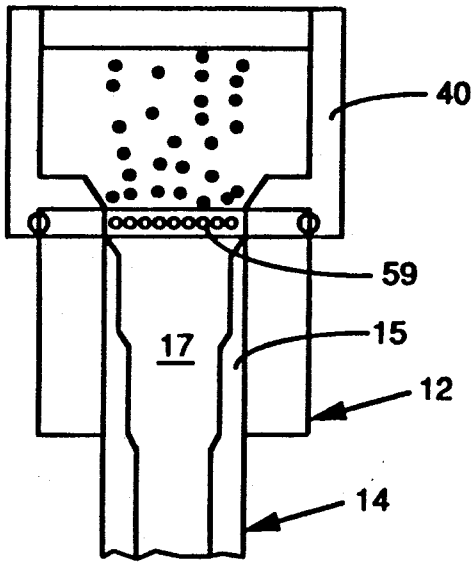

As above described, the pouring box outlet is provided with a connection 45. That connection may take the form of an insert, the function of which is to prevent solidification of the liquid metal at the outlet of the pouring box 40. FIGS. 4a–4c show several different types of such inserts.

FIG. 4a shows an insert 59 made of a porous refractory material allowing an inert gas to be blown through the holes in the refractory. The result of such blowing is to prevent contact of liquid metal with the insert. FIG. 4c shows another type of insert, 61, made of higher temperature resistance material having a melting point much higher than the liquid steel temperature in the mold. The molten steel will not freeze on the surface of the insert in contact with the liquid steel. FIG. 4b shows a higher temperature resistant material insert 62 with cast-in-place heating bars, inductive coil or resistant heating device, 63.

FIG. 5 depicts an arrangement wherein an insert 64 and adjacent part of the bottom of the pouring box 40 extend inwardly of the circumference of the mold inlet 46, forming a constricted pouring box outlet 44 having a width A smaller than the width B of the mold. In such an arrangement, a skin or shell 15 starts to form at the top of the mold and outwardly of the mold inlet 46, resulting in a solidifying shell 15 of non-uniform thickness, which interferes with the desired uniformity of cooling rate of the product 14 as it passes through the mold 1 2 and roll assembly 16.

In contrast, in FIG. 6, an insert 66 provides a pouring box outlet 44 having a width A substantially the same as the width B of the mold. In this arrangement according to the invention, the shell 15 forms in a uniform manner, gradually and smoothly increasing in thickness with increasing mold depth.

As further seen from FIG. 7, an insert 67 may advantageously be formed of a porous, refractory material so that an inert gas such as argon may be introduced, as by means of line 68, into the porous material, as at opening 69, and thence through the porous refractory and into the liquid metal in the area of the pouring box outlet in order to preclude freezing of the liquid metal in such areas and blockage of the pouring box outlet and the mold inlet.

An insert such as insert 67 of FIG. 7 is further illustrated in FIG. 8.

Casting apparatus which employs the present invention to introduce liquid metal into the mold at a relatively low velocity does not erode the pouring box outlet as quickly as does liquid metal flowing through prior art nozzles. In addition, the pouring box outlet is not as sensitive to plugging by aluminum-containing aggregates and other deposits as are prior art nozzles having narrow passageways for the casting of thin metal strands of thickness less than about 75 mm.

While a presently preferred embodiment of the present invention has been shown and described, it is to be understood that the invention is not limited thereto, but may be otherwise variously embodied within the scope of the following claims.

What is claimed is:

1. A method of continuously casting liquid metal into the form of a thin slab or strip having a thickness less than about 75 mm, comprising:

a. introducing liquid metal from a holding zone into an enclosed intermediate zone communicating with an inlet of a generally rectangular wall cooling zone having a width dimension less than about 75 mm. through an intermediate zone outlet having a single passageway of a length and width substantially the same as the length and width of the cooling zone inlet;

b. heating at least a portion of the intermediate zone to maintain the liquid metal therein at a desired pouring temperature;

c. maintaining continuous liquid communication from the intermediate zone to the cooling zone while flowing liquid metal from the outlet of the intermediate zone into the inlet of the cooling zone and between side walls of the cooling zone;

d. maintaining the side walls of the cooling zone at a temperature sufficiently low to cause solidification of liquid metal contacting said side walls;

e. oscillating the intermediate zone and the cooling zone in synchronization with each other first for about 4 to about 6 seconds at a mold travel rate substantially equal to the rate of withdrawal of cast product from the cooling zone to form a shell of solidified metal, second for about 1 second at a mold travel rate substantially higher than the rate of withdrawal of cast product from the cooling zone to compress the solidified metal shell and to break the sticking of the shell to the walls of the cooling zone, and third at a mold travel rate sufficient to return the cooling zone to its original position in about 1 second, and f. continuously withdrawing from the cooling zone a cast product consisting of a liquid core and a solidified shell from about 3 to about 6 mm. thick.

2. A method according to claim 1, further comprising heating the intermediate zone to maintain the liquid metal therein at a desired pouring temperature.

3. A method according to claim 1, wherein the outlet of the intermediate zone is heated to maintain the liquid metal therein at a desired pouring temperature.

4. A method according to claim 1, wherein the method further comprises placing the enclosed intermediate zone under inert gas pressure greater than ambient atmospheric pressure.

5. A method according to claim 1, wherein the width dimensions of the intermediate zone outlet and the cooling zone inlet are less than about 50 mm.

6. A method according to claim 1, further comprising passing an inert gas into the liquid steel as it passes through the intermediate zone outlet.

7. An apparatus for continuously casting liquid metal into the form of a thin slab or strip having a thickness less than about 75 mm, comprising:

a. liquid metal supply vessel;

b. a mold having an inlet, an outlet and cooled side wall one pair of which are spaced apart a distance less than about 75 mm;

c. an enclosed pouring box between the liquid metal supply vessel and the mold and provided with an inlet and with an outlet having a width and length substantially the same as the width and length of the mold inlet;

d. means to introduce liquid metal from the liquid metal supply vessel into the pouring box and thence through the pouring box outlet into the mold inlet thereby to maintain continuous liquid communication from the pouring box to the mold while flowing liquid metal from the pouring box outlet into the inlet of the mold and between the mold side walls;

e. means to heat at least a portion of the pouring box and to maintain the liquid metal therein at a desired pouring temperature;

f. means to maintain the side walls of the mold at a temperature sufficiently low to cause solidification of liquid metal contacting said side walls;

g. means to oscillate the pouring box and the mold in synchronization with each other, and h. means to continuously withdraw from the mold a cast product consisting of a solidified shell and a liquid core.

8. An apparatus according to claim 7, wherein one pair of the mold side walls are spaced apart a distance less than about 50 mm.

9. An apparatus according to claim 7, comprising means to heat the pouring box outlet and to maintain the liquid metal therein at a desired pouring temperature.

10. An apparatus according to claim 9, including means to place the pouring box under an inert gas atmosphere at a pressure above ambient atmosphere pressure.

11. An apparatus according to claim 7, comprising means to heat substantially the entire pouring box and to maintain the liquid metal therein at a desired pouring temperature.

12. An apparatus according to claim 11, including means to place the pouring box under an inert gas atmosphere at a pressure greater than ambient atmosphere pressure.

13. An apparatus according to claim 7, wherein the oscillation means includes means to move the mold and pouring box downwardly at least about 400 mm. within a period of about 4 to about 6 seconds, thereby first to form a shell of solidified metal about 3 to about 6 mm thick, then to move the mold and pouring box downwardly for about 1 second at a rate substantially greater than the rate of withdrawal of cast product from the mold thereby to compress the solidified metal shell and break the sticking of the shell to the side walls of the mold, and then to return the mold and pouring box to their original position in about 1 second.

14. Apparatus according to claim 13, wherein a refractory insert surrounds the pouring box outlet adjacent the mold inlet.

15. Apparatus according to claim 13, wherein the refractory insert is made of a porous material adapted to pass an inert gas into the liquid steel in the pouring box outlet.

16. Apparatus according to claim 15, further comprising means to heat the refractory insert.

17. Apparatus for continuously casting a metal strand comprising a tundish, an enclosed pouring box, means for heating at least an outlet portion of the pouring box, means for introducing liquid metal into the pouring box, means for maintaining an inert gas atmosphere in the pouring box at a pressure above ambient atmospheric pressure, a mold having an inlet, an outlet and cooled side walls, one opposed pair of said side walls being spaced apart a distance less than about 75 mm, the pouring box having an outlet of substantially the same width and length of the mold inlet, means to oscillate the mold and the pouring box in a manner to form in the mold a cast strand having a solid metal skin and a liquid metal core, means continuously to withdraw the strand from the mold, and means thereafter to solidify the liquid core of the strand.

18. Apparatus according to claim 17, further comprising a refractory insert in the pouring box outlet juxtaposed to the mold inlet.

19. Apparatus according to claim 18, further comprising mean to heat the refractory insert.

20. Apparatus according to claim 19, wherein the refractory insert is made of a gas permeable material, and the apparatus further includes means to introduce a gas into the porous refractory insert.

* * * * *